US006446763B1

(12) United States Patent
Glassey et al.

(10) Patent No.: US 6,446,763 B1
(45) Date of Patent: Sep. 10, 2002

(54) INTEGRATED ELEVATOR INSTALLATION HOIST TOOL

(75) Inventors: Tom E. Glassey, Plainville; Michael Lang, Southbury, both of CT (US); Jacobus Benjamin Legez, De Kwakel (NL); Bruce St. Pierre, Bristol; Bruce Swaybill, Farmington, both of CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/619,907

(22) Filed: Jul. 19, 2000

(51) Int. Cl.[7] ..... B66B 7/00
(52) U.S. Cl. ..... 187/414; 52/30
(58) Field of Search ..... 52/30; 187/414

(56) References Cited

U.S. PATENT DOCUMENTS 5,000,292 A * 3/1991 Chapelain et al. ..... 187/1 R
6,006,865 A 12/1999 Ammon
6,193,017 B1 * 2/2001 Koster ..... 187/258

FOREIGN PATENT DOCUMENTS

| | | | |
|---|---|---|---|
| EP | 0 375 208 A1 | | 6/1990 |
| JP | 02089791 | | 3/1990 |
| JP | 4-324478 | * | 2/1992 |
| JP | 7-237847 | * | 9/1995 |
| JP | 8-2850 | * | 1/1996 |
| JP | 9-272671 | * | 10/1997 |
| JP | 11-322230 | * | 11/1999 |

* cited by examiner

*Primary Examiner*—Thomas J. Brahan

(57) ABSTRACT

A hoist tool for lifting a machine assembly in an elevator to an installation position is mounted to a machine beam which also supports the machine assembly. The hoist tool is thus mounted in a location where it does not require any additional axial space. Preferably, the hoist tool is mounted to one lateral side of the machine assembly, and within an axial extension of the machine assembly downwardly from the machine beam into the hoistway.

10 Claims, 3 Drawing Sheets

INTEGRATED ELEVATOR INSTALLATION HOIST TOOL

BACKGROUND OF THE INVENTION

This invention relates to mounting structure for an elevator installation hoist tool that requires less space than the prior art.

Elevators are utilized in most modern buildings which extend upwardly for more than a few stories. An elevator typically includes a cab which is movable within a hoistway. A motor and pulley arrangement, known as the machine, is mounted near the top of the hoistway, and drives a cable to move the elevator cab upwardly or downwardly in combination with a counterweight. Historically, the machine is mounted in a machine room above the hoistway. Typically, machine beams define an upper end of the hoistway and a plate is mounted on a vertically upper surface of the machine beams. This plate supports the machine, and defines a lower surface of the machine room.

A hoist tool is necessary for lifting the machine upwardly into the machine room during initial installation of the elevator. Moreover, the hoist tool is typically left adjacent the machine room, in case it ever becomes necessary to move the machine back downwardly for replacement or repair. Typically, a crane-like apparatus is mounted in the machine room.

More recently, the assignee of the present application has developed an improved location for the machine which requires less space. It is desirable to more efficiently utilize space in a building, and the requirement of a large machine room near the upper end of the building may sometimes be undesirable. Thus, elevators have been proposed wherein the machine is supported to hang downwardly from the machine beams, and toward the hoistway. However, there has been no proposed hoist tool for lifting the machine to this upper location that would not require additional space. Using additional space for the hoist tool would in some respects reduce the benefits of having the machine hang downwardly from the machine beams.

SUMMARY OF THE INVENTION

In a disclosed embodiment of this invention, a hoist tool for lifting the machine upwardly through the hoistway of an elevator is mounted to the machine beams which support the machine once it is lifted through the hoistway. More particularly, the hoist tool is preferably mounted at a side of the machine in the hoistway such that it does not require additional axial space within the building. In a most preferred embodiment, machine beams support the machine at an upper surface and the machine hangs downwardly from the machine beam. The hoist tool also hangs downwardly from the machine beam, and to one lateral side of the machine. Although it is preferred that the hoist tool be mounted to a machine beam, it is also within the scope of this invention that the hoist tool be mounted to some other mounting structure, but still positioned within the axial length of the machine, and to the side of the machine.

In further details of this invention, the hoist tool incorporates a motor driving a cable for lifting the machine. A pulley sheave is mounted on the machine beam and the cable moves over the pulley sheave, and is connected to a lift point also on the machine beam. The cable extends over two pulley sheaves mounted on a frame for supporting the machine. Through this structure the machine is lifted by the hoist tool.

These and other features of the present invention can be best understood from the following specification and drawings, the following of which is a brief description.

DETAILED DESCRIPTION OF A PREFERRED EMBODIMENT

Figure 1:
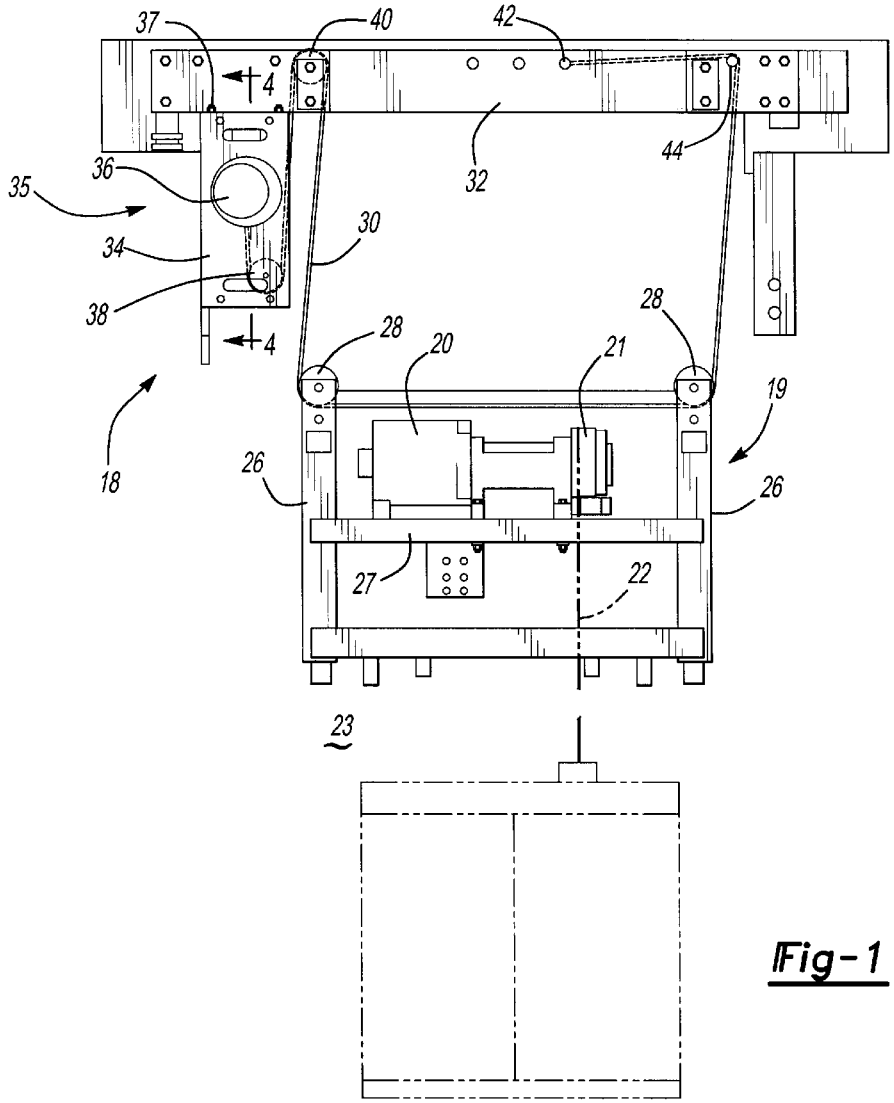
FIG. 1 is a view showing the mounting of a machine.

An elevator system 18 is shown in FIG. 1 having a machine assembly 19. The machine assembly 19 incorporates the machine including a motor 20 and a pulley sheave 21 for driving a cable 22. As is known, the cable 22 will extend within a hoistway 23 and lift the cab 24, once the machine assembly 19 is operational. The cab 24 and cable 22 are shown schematically in this figure, as this figure shows the movement of the machine assembly 19. Typically, the cab 24 would not be connected to the machine during this step.

The machine assembly 19 incorporates not only the motor 20 and pulley sheave 21, but also frame sides 26. A plate 27 extends laterally between the frame sides 26 and actually supports the motor 20 and pulley sheave 21. The plate 27 extends into the plane of this figure, and a second set of frame sides is at an opposed end of plate 27. The details of the motor 20 and pulley sheave 21 are shown somewhat schematically, and it should be understood that the machine will also typically include other equipment such as a brake, etc.

Pulley sheaves 28 are mounted in each of the side frames 26 and receive a cable 30. The cable 30 extends under the pulley sheaves 28 and across the lateral width of the machine assembly 19.

A machine beam 32 extends laterally across the hoistway 23. A hoist tool 35 includes a mounting bracket 34 extending downwardly from the beam 32. A hoist motor 36 is mounted in the bracket 34. A pulley sheave 38 is also mounted within the bracket 34, and a pulley sheave 40 is mounted on the beam 32. The cable 30 extends from the motor 36 around the sheave 38 and upwardly over the sheave 40, and then to the sheaves 28. From the opposed pulley sheave 28, the cable 30 extends upwardly to a fixed point or lift point 42 on the beam 32. The cable 30 also extends around a pin 44 on the beam 32.

When the machine assembly 19 is being installed into the elevator 18, the motor 36 is driven to lift the machine assembly 19 upwardly. Assembly 19 is then mounted to the beam 32. Once the machine assembly 19 is mounted to the beam 32, the hoist tool 35 still typically remains in the elevator 18. As can be seen, the bracket 34 is fixed by bolts 37 to the beam 32.

Figure 2:
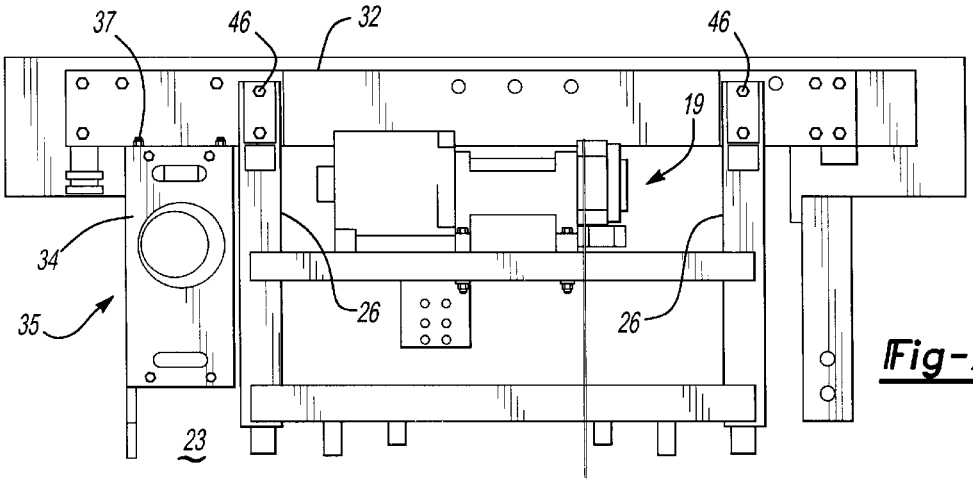
FIG. 2 shows the machine and frame mounted to a machine beam.

As can be appreciated from FIG. 2, the machine assembly 19 has now been mounted, such as by bolts 46 extending into bolt holes in the beam 32. The hoist tool 35 can be seen to be mounted to the lateral side of the machine assembly 19, and within an axial length of the machine assembly 19 defined extending along the hoistway 23.

Figure 3:
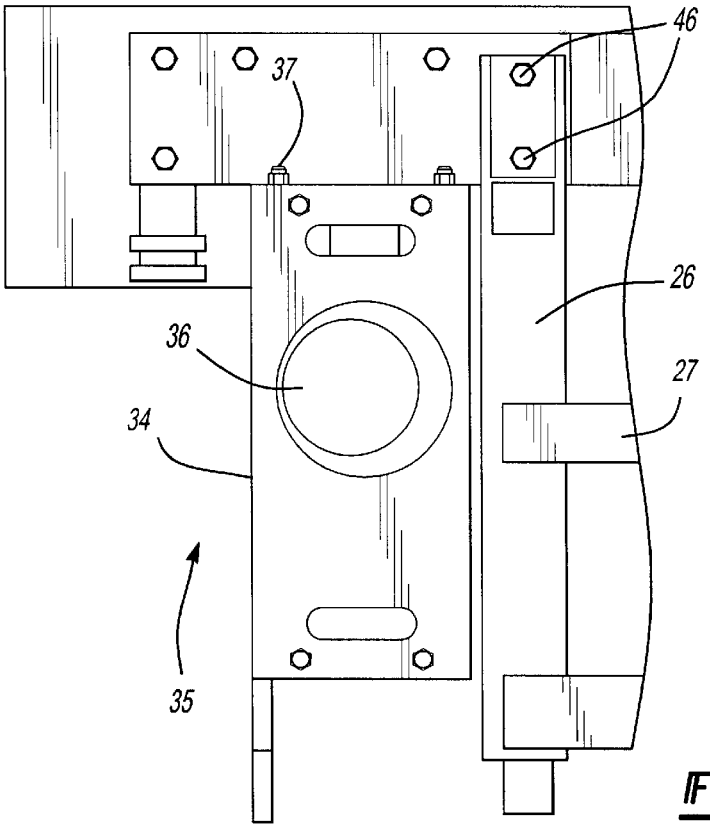
FIG. 3 is a detail of one side of the arrangement of FIG. 2.

As shown in FIG. 3, the bracket 34 may be formed of sheet metal, and supports the motor 36. Again, bolts 37 support the bracket 34 on the beam 32. Bolts 46 fix the machine assembly 19 frame sides 26 to beam 32.

While the hoist tool 35 is shown mounted to the machine beam 32, within the scope of this invention, the hoist tool 35 could be mounted to a wall or other support structure other than the beam 32. In such an embodiment, the hoist tool 35 is still preferably to a lateral side of the machine assembly 19, and within the length of the machine assembly 19. However, it should be understood that the preferred embodiment mounts the hoist tool 35 to the machine beam 32.

Figure 4:
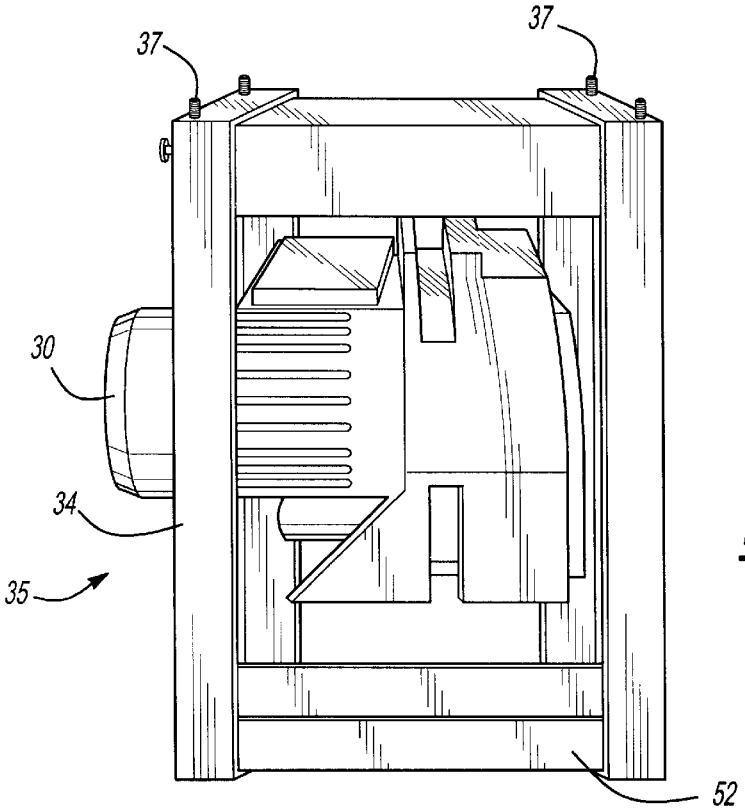
FIG. 4 is a cross-sectional view along line 4—4 as shown in FIG. 1.

FIG. 4 shows hoist tool 35. As shown, there are bolts 37 at two spaced locations along the frame of the hoist tool. There is further a bottom plate 52 making the bracket 34 rigid. As also shown, the motor 30 extends forwardly of the bracket frame 34.

Figure 5:
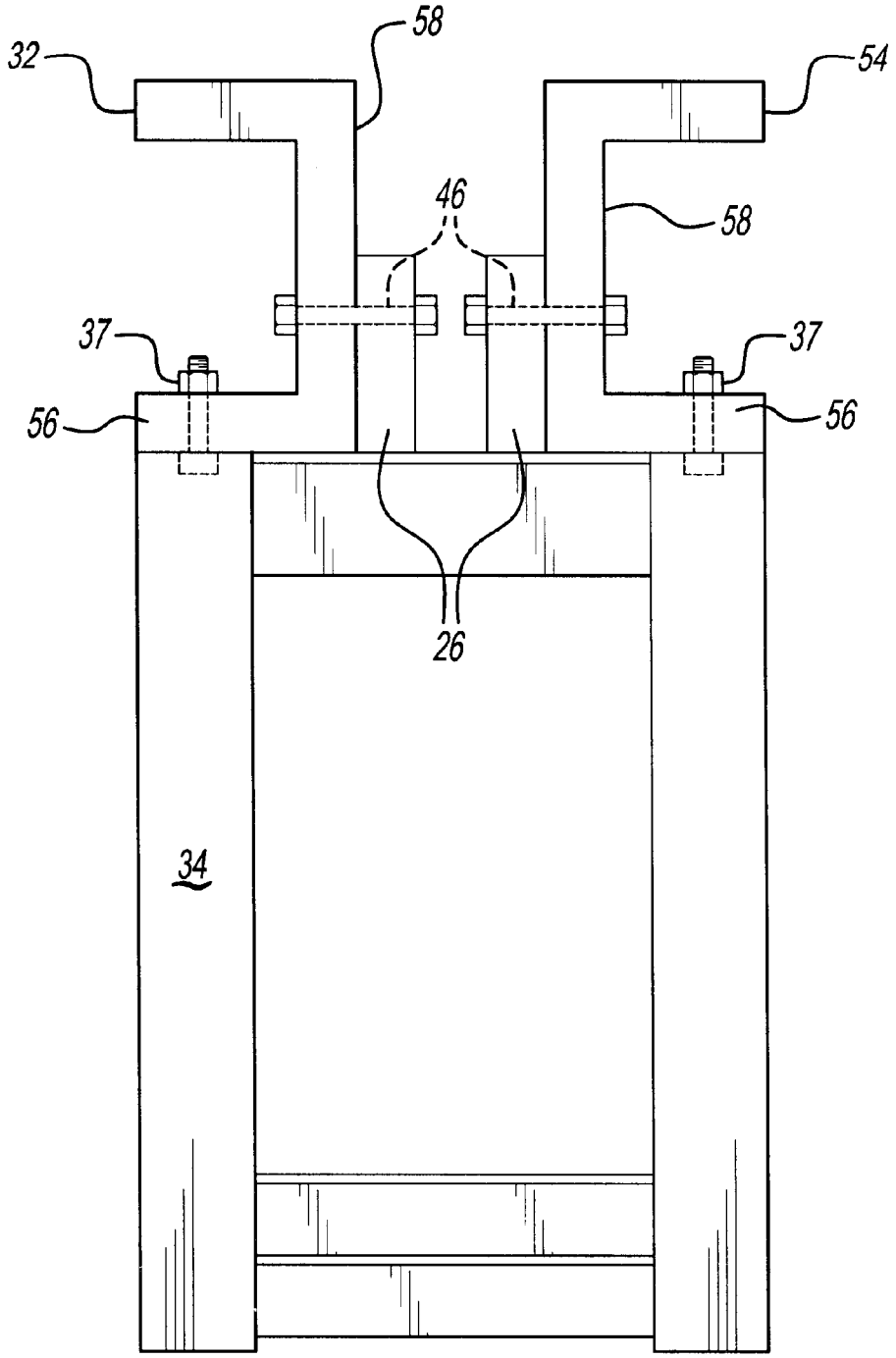
FIG. 5 is a schematic view showing the mounting of the hoist tool and the machine assembly to the machine beams.

FIG. 5 is a schematic view roughly along the same direction as FIG. 4. As shown, the bracket 34 has its bolts 37 fixed to both of a pair of machine beams 32 and 54. As is shown, the bolts 37 are attached to a bottom face 56 of the c-shaped beams 32 and 42. Similarly, further into the plane of the paper in FIG. 5, portions of frame sides 26 are fixed by bolts 46 to the rear surface 58 of the c-shaped machine beams 32 and 54. As can be appreciated from the combination of the FIGS. 1–5, the present invention thus incorporates the hoist tool in a relatively small space.

A preferred embodiment of this invention has been disclosed; however, a worker in this art would recognize that certain modifications would come within the scope of this invention. For that reason, the following claims should be studied to determine the true scope and content of this invention.

What is claimed is:

1. An elevator assembly comprising:

a machine beam extending through a lateral width;

a machine assembly including a lift motor for lifting an elevator cab and a frame mounting said lift motor, said machine assembly being supported by said machine beam; and a hoist tool including a motor for lifting said machine assembly upwardly through a hoistway to a support location on said machine beam, said hoist tool fixed to said machine beam.

2. An elevator assembly as recited in claim 1, wherein both said machine assembly and said hoist tool are mounted to hang downwardly from said machine beam.

3. An elevator assembly as recited in claim 2, wherein said hoist tool drives a cable arranged around pulley sheaves to lift said machine assembly, and at least one of said pulley sheaves being mounted on said machine beam.

4. An elevator assembly as recited in claim 3, wherein said cable for lifting said machine assembly is fixed to said machine beam at a lift point, and further extends around said pulley sheave on said machine beam, then around a pair of spaced pulley sheaves on said machine assembly, and is then fixed to said lift point.

5. An elevator assembly as recited in claim 4, wherein said pair of spaced pulley sheaves are mounted on respective sides of a frame in said machine assembly, and said lift motor being mounted on a plate extending laterally between said side frames.

6. An elevator assembly as recited in claim 1, wherein said hoist tool is mounted on a bracket, said bracket being attached to said machine beam.

7. An elevator assembly as recited in claim 1, wherein there are a pair of machine beams, with said machine assembly being fixed to both of said pair of machine beams, and said hoist tool further being fixed to both of said machine beams.

8. An elevator assembly comprising:

a machine beam extending through a lateral width;

a machine assembly including a lift motor for lifting an elevator cab and a frame mounting said lift motor, said machine assembly being supported by said machine beam; and a hoist tool including a motor for lifting said machine assembly through a hoistway and to a support location on said machine beam, said machine assembly being mounted to hang downwardly from said machine beam for an axial distance into said hoistway, and said hoist tool being mounted to a lateral side of said machine assembly and at least partially within said axial distance of said machine assembly hangs into said hoistway.

9. An elevator assembly as recited in claim 8, wherein said machine assembly and said hoist tool are both fixed to said machine beam, and said hoist tool driving a cable arranged around a pulley sheave mounted on said machine beam, said cable being fixed to said machine beam at a lift point, and said cable extending around a pair of spaced pulley sheaves on said machine assembly intermediate said pulley sheave on said machine beam and said lift point.

10. A method of lifting a machine assembly through a hoistway to a mount location in an elevator assembly, said method including the steps of:

(1) providing a hoist tool including a motor and being mounted adjacent an upper end of a hoistway, and providing a machine assembly having a lift motor for driving an elevator cab, said hoist tool being operably connected to lift said machine assembly;

(2) mounting said hoist tool to a machine beam to hang downwardly from said machine beam;

(3) utilizing said hoist tool motor to lift said machine assembly through said hoistway to an upward position, and then attaching said machine assembly to said machine beam, and said machine assembly also being mounted to hang downwardly from said machine beam.

* * * * *